United States Patent [19]

McGinley

[11] 4,122,872

[45] Oct. 31, 1978

[54] METHOD AND APPARATUS FOR INSERTING WEFT IN A WARP-WAVE WEAVING SYSTEM

[76] Inventor: Thomas F. McGinley, 175 Prospect St., Phillipsburg, N.J. 08865

[21] Appl. No.: 729,148

[22] Filed: Oct. 4, 1976

[51] Int. Cl.[2] ..... D03D 47/00

[52] U.S. Cl. ..... 139/11; 139/439

[58] Field of Search ..... 139/11, 20, 28, 48, 139/429, 435, 436, 439, 453, 134

[56] References Cited

U.S. PATENT DOCUMENTS

| | | | |
|---|---|---|---|
| 1,859,952 | 5/1932 | Bogdanffy | 139/11 |
| 2,392,489 | 1/1946 | Martin | 139/28 |
| 2,742,058 | 4/1956 | Gentilini | 139/28 |
| 2,796,084 | 6/1957 | Pfarrwaller | 139/453 |
| 2,893,440 | 7/1959 | Brusadelli | 139/28 |
| 2,948,302 | 8/1960 | Bejeuhr | 139/11 |
| 2,993,130 | 7/1961 | Laithwaite | 139/134 |
| 3,310,071 | 3/1967 | Mauri | 139/11 |
| 3,848,642 | 11/1974 | Steiner | 139/28 |
| 3,982,567 | 9/1976 | Pfarrwaller et al. | 139/439 |

FOREIGN PATENT DOCUMENTS

| | | | |
|---|---|---|---|
| 2,602,511 | 7/1976 | Fed. Rep. of Germany | 139/11 |
| 819,974 | 9/1959 | United Kingdom | 139/28 |

*Primary Examiner*—Henry S. Jaudon

*Attorney, Agent, or Firm*—Lerner, David, Littenberg & Samuel

[57] ABSTRACT

A method and apparatus is provided for weaving which utilizes a plurality of moving warp sheds, wherein the sheds move in a direction parallel to the warp threads, and wherein gripper shuttles are employed for carrying weft threads from one side of the machine and through the moving sheds to the other side of the machine, with the gripper shuttles being unconnected to the machine, during their traverse through the moving warp sheds. The weft threads are supplied from a weft supply station which includes a plurality of stationary weft supply spools. The weft threads are supplied to a plurality of weft feeders and guides which operate to successively transfer the weft threads to the gripper shuttles. Once the gripper shuttles have been loaded with weft thread, the gripper shuttles are ready to be fired through the moving warp sheds. Before a gripper shuttle enters a moving warp shed, its lateral speed is synchronized with the lateral speed of the moving warp shed. Once the gripper shuttle enters the moving warp shed, it operates to lay weft thread in the moving warp shed during the entire time that it traverses the moving warp shed. As the gripper shuttle emerges from the moving warp shed, the gripper shuttle is received and stopped at a receiving station.

67 Claims, 19 Drawing Figures

FIG. 8
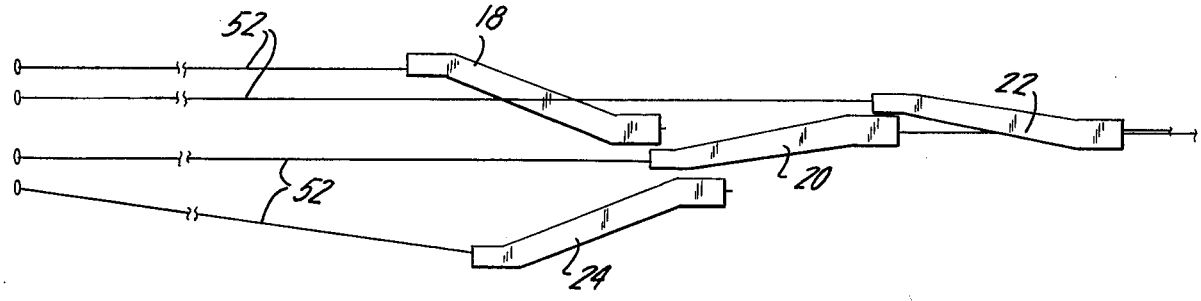
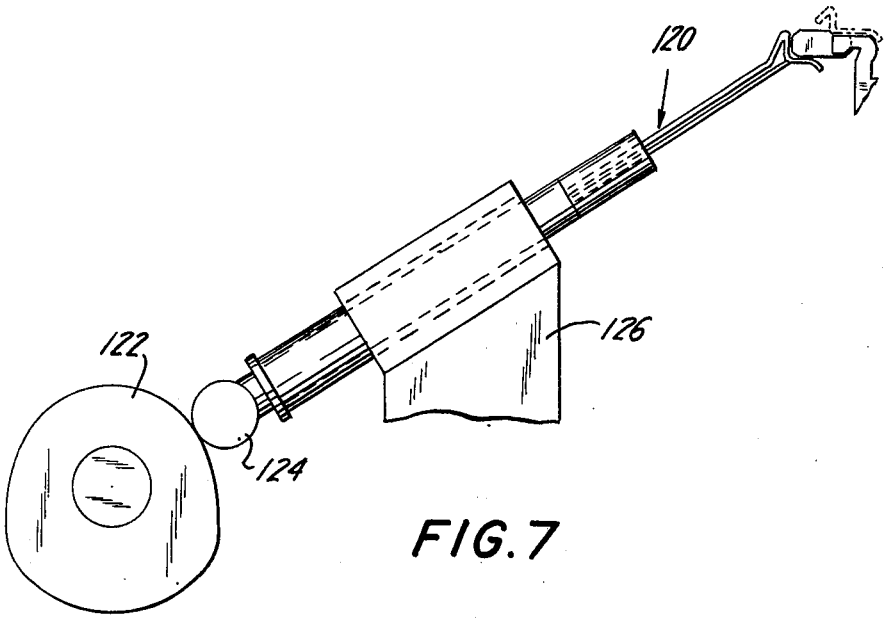
FIG. 7

132
10
120a
118a
118b
128
124b
124a
130
122b
120b
122a
10
142
11
140
144
118c
11
118
124c
124
18
16
20a
122
120
20
52
22
22a
24

METHOD AND APPARATUS FOR INSERTING WEFT IN A WARP-WAVE WEAVING SYSTEM

FIELD OF THE INVENTION

The present invention relates generally to a method and apparatus for weaving and specifically relates to a method and apparatus for weaving which utilizes a plurality of moving warp sheds, wherein the sheds move in a direction parallel to the warp threads, (hereinafter referred to as warp-wave weaving), and wherein gripper shuttles are employed for carrying the weft threads from one side of the machine and through the moving sheds to the other side of the machine, with the gripper shuttles being unconnected to the machine during their traverse through the moving warp sheds.

REFERENCE TO RELATED APPLICATION

This application is related to my copending application, Ser. No. 703,307, filed July 7, 1976. This copending application discloses a novel system for warp-wave weaving and further discloses a novel system for employing free-flying shuttles (i.e., shuttles unattached to the weaving machine) for inserting and laying weft in warp-wave weaving systems.

BACKGROUND OF THE INVENTION

Along with the development of warp-wave weaving systems, the prior art has also developed apparatus for inserting weft threads into a plurality of warp sheds as they move in a direction parallel to the warp threads. For example, such prior art systems are disclosed in U.S. Pat. No. 2,742,058 (Gentilini), U.S. Pat. No. 3,310,071 (Mauri), and United Kingdom Patent No. 819,974 (Ripamonti). However, all of these prior art systems, and those similar to them, utilize needles, rapiers, or like members, of either the flexible or rigid type, which members remain attached or connected to the weaving machine during their traversal through the moving warp sheds to lay the weft thread. Therefore, it is necessary in such systems to retract the wef-laying member to the side of the machine from which the weft thread is supplied. Such an arrangement has the disadvantage of using one-half of the time interval that the weft-laying member is within the warp shed for the non-productive motion of withdrawal or retraction of the weft-laying member from the shed after laying of the weft thread.

This drawback was recognized in my above-identified copending application, and it discloses a method and apparatus for employing shuttles for simultaneously laying weft threads in a plurality of moving warp sheds, which overcomes this drawback. More particularly, the above-mentioned copending application discloses the use of shuttles for simultaneously laying more than one weft thread in a warp-wave weaving system, wherein the shuttles are fired from at least one side of the machine, through the moving warp sheds, and are stopped on the other side of the machine. The shuttles are unconnected to the machine during their traversal of the moving warp sheds, and it is therefore unnecessary to retract the shuttles through the moving sheds. In this manner, the shuttles disclosed in the above-mentioned copending application operate to lay weft in the moving sheds of a warp-wave weaving system during the entire time that the shuttles traverse the moving sheds.

However, it would be highly desirable to develop a system which employs a shuttle for carrying and laying weft thread in a warp-wave weaving system in the above-described manner, wherein the shuttle is smaller than and operates faster than the above-described shuttle. A system having a faster moving weft-laying shuttle would provide increased production, and its smaller size would allow smaller shed openings, thereby providing less strain on the warp threads.

Moreover, the prior art systems referred to above, which employ needles or rapiers for weft insertion in warp-wave weaving systems, typically draw the weft thread from a system of rotating weft supply spools. Such a method of weft supply has the disadvantage of requiring the weaving machine or loom to be stopped each time a weft supply spool must be replaced, and also requires complicated and costly mechanisms to rotate the weft supply spools and to properly tension the weft threads.

It would therefore also be highly desirable to provide a system for the insertion and laying of weft thread in a warp-wave weaving system, wherein the weft threads are supplied and drawn from stationary weft supply spools rather than the conventional rotating weft supply spools.

Broadly, it is an object of the present invention to provide a method and apparatus for laying weft threads in a warp-wave weaving system which overcomes one or more of the aforesaid problems. Specifically, it is within the contemplation of the present invention to provide an improved weft supply and insertion system for warp-wave weaving which utilizes a weft-laying shuttle which is smaller and faster than prior art weft insertion members employed in warp-wave weaving systems in order to provide increased production and to reduce the strain on warp threads by providing smaller shed openings.

It is a further object of the present inention to provide a system for supplying and laying weft threads in a warp-wave weaving system, wherein the weft threads are supplied and drawn from stationary weft supply spools.

A still further object of the invention is to provide an improved weft-laying system for warp-wave weaving, wherein the weft threads are accurately and continuously guided to move in a lateral direction in unison with the laterally-moving warp sheds during the transversal of the weft-laying shuttle through the moving warp shed.

A still further object of the present invention is to provide a system for accurately and continuously controlling the position and tension of each of a plurality of weft threads in order to supply weft thread to a plurality of gripper shuttles which simultaneously draw a plurality of weft threads from a plurality of stationary weft supply spools.

A still further object of the present invention is to provide a system for transferring a plurality of weft threads from a plurality of stationary weft supply spools to a plurality of weft-carrying shuttles.

A still further object of the present invention is to provide a system for firing weft-carrying shuttles into moving warp sheds which move in a direction perpendicular to the direction in which the weft-carrying shuttles are initially fired.

A still further object of the present invention is to provide an improves system for warp-wave weaving which achieves a great increase in the rate of fabric production without sacrificing versatility in the variety of fabrics which can be produced.

SUMMARY OF THE INVENTION

Briefly, in accordance with the principles of the present invention, there is provided an improved system for inserting weft thread in a warp-wave weaving loom. More particularly, gripper shuttles are employed for carrying the weft threads from one side of the loom, through the moving warp sheds, and to the other side of the loom, with the gripper shuttles being unconnected to the machine during their traverse through the moving warp sheds. As a result of the present invention, it is no longer necessary in such moving warp systems to retract a weft-laying member to the side of the loom from which the weft thread is picked or fired, and thereby avoids the disadvantage of prior art systems which utilized one-half of the time interval that the weft-laying member is within the warp shed for the non-productive motion of withdrawal or retraction of the weft-laying member from the moving warp shed after laying of the weft thread. Advantageously, in accordance with the present invention, weft thread is laid in the moving warp sheds during the entire time that the gripper shuttle traverses the moving warp shed. This advantage is accomplished by the use of gripper shuttles, which are sequentially fired and operate to simultaneously lay one or more weft threads in the warp-wave weaving system. The gripper shuttles are fired from at least one side iof the loom, through the moving warp sheds, and are stopped on the other side of the machine.

Moreover, the gripper shuttles employed in the present invention are faster than conventional weft-laying shuttles, and thereby provide increased production. In addition, the smaller size of the gripper shuttles employed in the present invention allow smaller warp shed openings and thereby also provide the additional advantage of less strain on the warp threads.

Moreover, in the present invention, the disadvantage of requiring the weaving loom to be stopped each time a weft supply spool must be replaced has been eliminated. More particularly, in the present invention, the weft threads are supplied and drawn from stationary weft supply spools rather than rotating weft supply spools. In this manner, the weft supply spools may be replaced without stopping the operation of the loom.

Briefly, in accordance with the present invention, weft thread is supplied from a weft supply station, which includes a plurality of stationary weft supply spools. The weft threads are supplied to a plurality of weft feeders and guides which operate to successively transfer the weft threads to a plurality of gripper shuttles. Once the gripper shuttles have been loaded with weft thread, the gripper shuttles are ready to be fired through the moving warp sheds of a warp-wave weaving loom. Before the gripper shuttles enter the moving warp sheds, their lateral speed is synchronized with the lateral speed of the moving warp sheds. Once the gripper shuttle enters the moving warp sheds, it operates to lay weft thread in the moving warp shed during the entire time that it traverses the moving warp shed. As the gripper shuttle emerges from the moving warp shed, the gripper shuttle is received and stopped at a receiving station.

Accordingly, it should be noted that as a result of the novel weft-inserting apparatus of the present invention, one or more gripper shuttles are operating to lay weft thread in the moving warp sheds at any given instant. Accordingly, in addition to eliminating the need for the non-productive motion of retraction of the weft-laying member from the moving warp shed, the present invention achieves a further increase in the rate of fabric production as a result of its capability of laying one or more weft threads within the moving warp sheds at any given instant.

BRIEF DESCRIPTION OF THE DRAWINGS

Further objects, features, and advantages of the present invention will become apparent upon the consideration of the following detailed description of presently-preferred embodiments, when taken in conjunction with the accompanying drawings, wherein:

FIG. 7 is a side elevational view of a lifting pin mechanism for lifting the weft thread over the picking head;

FIG. 8 is a side elevational view schematically representing the relative positions of the weft feeders and guides of the present invention;

DETAILED DISCUSSION OF FIRST EMBODIMENT OF THE INVENTION

Figure 1:
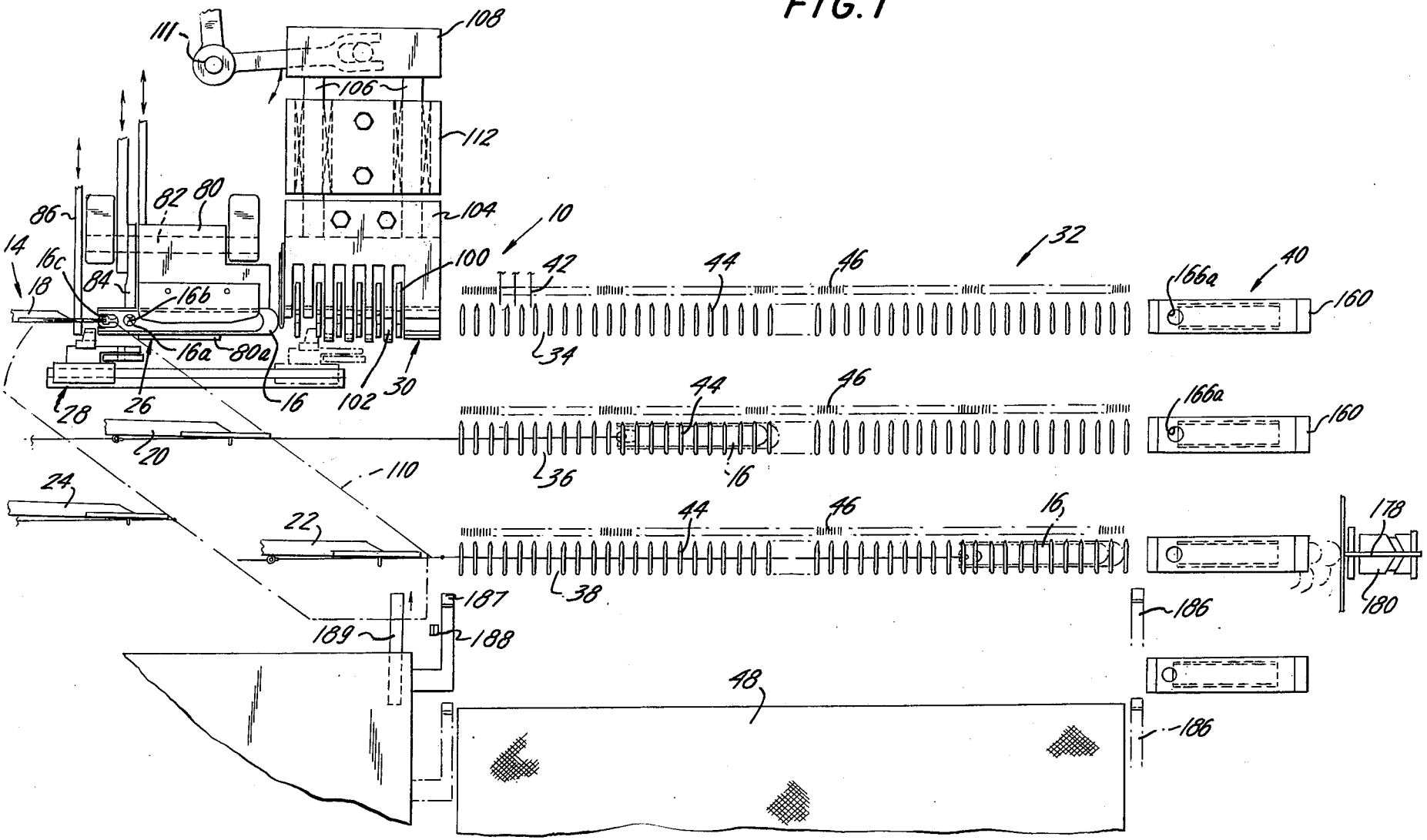
FIG. 1 is a plan view of the novel weft-insertion system of the present invention for inserting and laying weft thread in a warp-wave weaving loom.

Referring now to FIG. 1, there is shown a system for inserting weft in a warp-wave weaving loom which embodies the concepts of the present invention, generally designated by the reference numeral 10, and which includes the following subassemblies or stations: a station 14 which employs a plurality of weft feeders and guides designated 18, 20, 22, and 24 for transferring a plurality of weft threads from a weft supply station 12 (shown in FIG. 2) to gripper shuttles 16; a station 26 for firing loaded gripper shuttles 16 through a moving warp shed system 32, which employs a firing mechanism 28; a synchronizer 30 through which the gripper shuttle 16 travels and while traveling therethrough, the synchronizer 30 imparts a lateral movement to the gripper shuttle 16, which is perpendicular to the direction that the gripper shuttle 16 is initially fired, so that the lateral velocity of gripper shuttle 16 is synchronized with the lateral velocity of the moving warp sheds; a warp-wave weaving loom 32 which includes a plurality of moving warp sheds designated as 34, 36, and 38 through which gripper shuttles 16 travel; and a receiving station 40 for receiving and stopping gripper shuttles 16 after their traversal through the moving warp sheds. In operation, weft thread is supplied from the weft supply station 12 to the weft feeders 18, 20, 22, and 24, which operate to successively transfer weft thread to each gripper shuttle 16 which is brought into firing station 26 for firing the gripper shuttles 16. Firing mechanism 28 operates to fire successive loaded gripper shuttles through the synchronizer 30 and through the moving warp sheds 34, 36, and 38. Accordingly, at any given time, at least two gripper shuttles 16 are laying weft thread in the moving warp sheds, and they do so during their entire time that they traverse the moving warp sheds. On the other side of the moving warp sheds, the gripper shuttles 16 are received and stopped at receiving station 40.

As shown most clearly in FIG. 1, warp-wave weaving loom 32 operates on warp threads 42 and includes guide members 44 which define the moving warp sheds 34, 36, and 38 and reed members 46 for effecting beat up of the weft threads. Reference is made to my copending application (Ser. No. 703,307) for a detailed description of the manner in which the warp sheds 34, 36, and 38 are formed, retained, and moved toward the fell of the cloth 48. As shown in FIG. 1, in the present invention, one gripper shuttle is laying weft thread in warp shed 36, while another gripper shuttle is simultaneously laying weft thread in warp shed 38, in a manner to be explained.

Figures 2, 6:
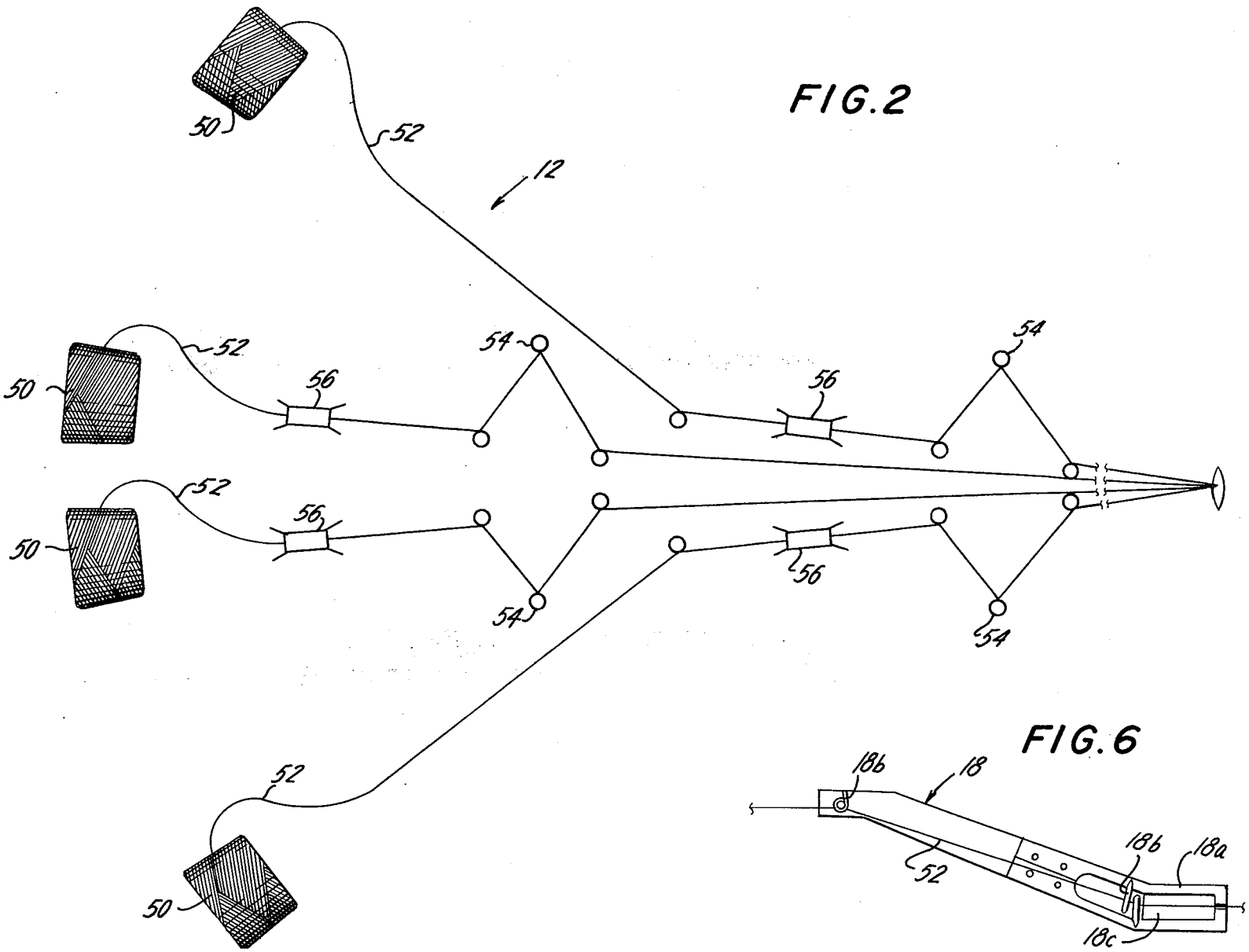
FIG. 2 is a schematic representation of a stationary weft supply station, including tensioning apparatus and compensators.
FIG. 6 is a side elevational view in detail of one of the weft feeders of the present invention.

Referring now to FIG. 2, there is shown in detail the apparatus for supplying and controlling the tension of a plurality of weft threads in order to supply weft thread to the plurality of weft feeders and guides 18, 20, 22, and 24. More particularly, weft supply station 12 includes stationary weft supply spools 50, which supply weft threads 52 to tensioning and braking devices, generally referenced 56, and thence to compensating assemblies 54 in a manner generally conventional with gripper shuttle looms. The tension on weft threads 52 are thereby adjusted and controlled to take up any slack as necessary, with the weft threads 52 being supplied to their respective weft feeders 18, 20, 22, or 24. Each of the weft feeders 18, 20, 22, or 24 operates to draw the weft thread from its associated supply spool 50 and transfer same to a gripper shuttle 16.

Figure 3:
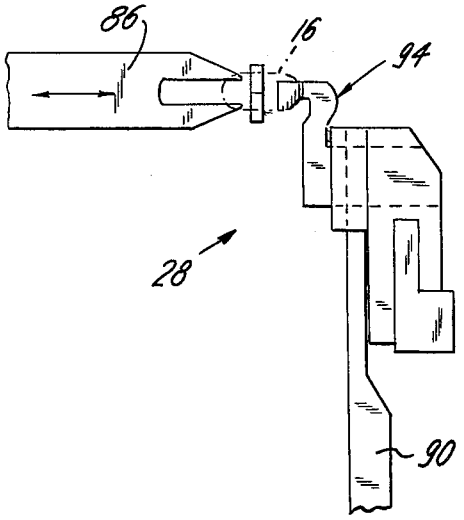
FIG. 3 is a side elevational view of a picking head employed in the present invention.
Figure 4:
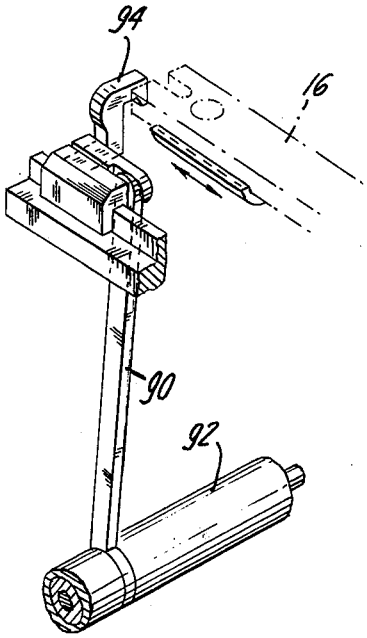
FIG. 4 is a partial perspective view of a gripper shuttle loading arm and shooting mechanism.
Figure 14:
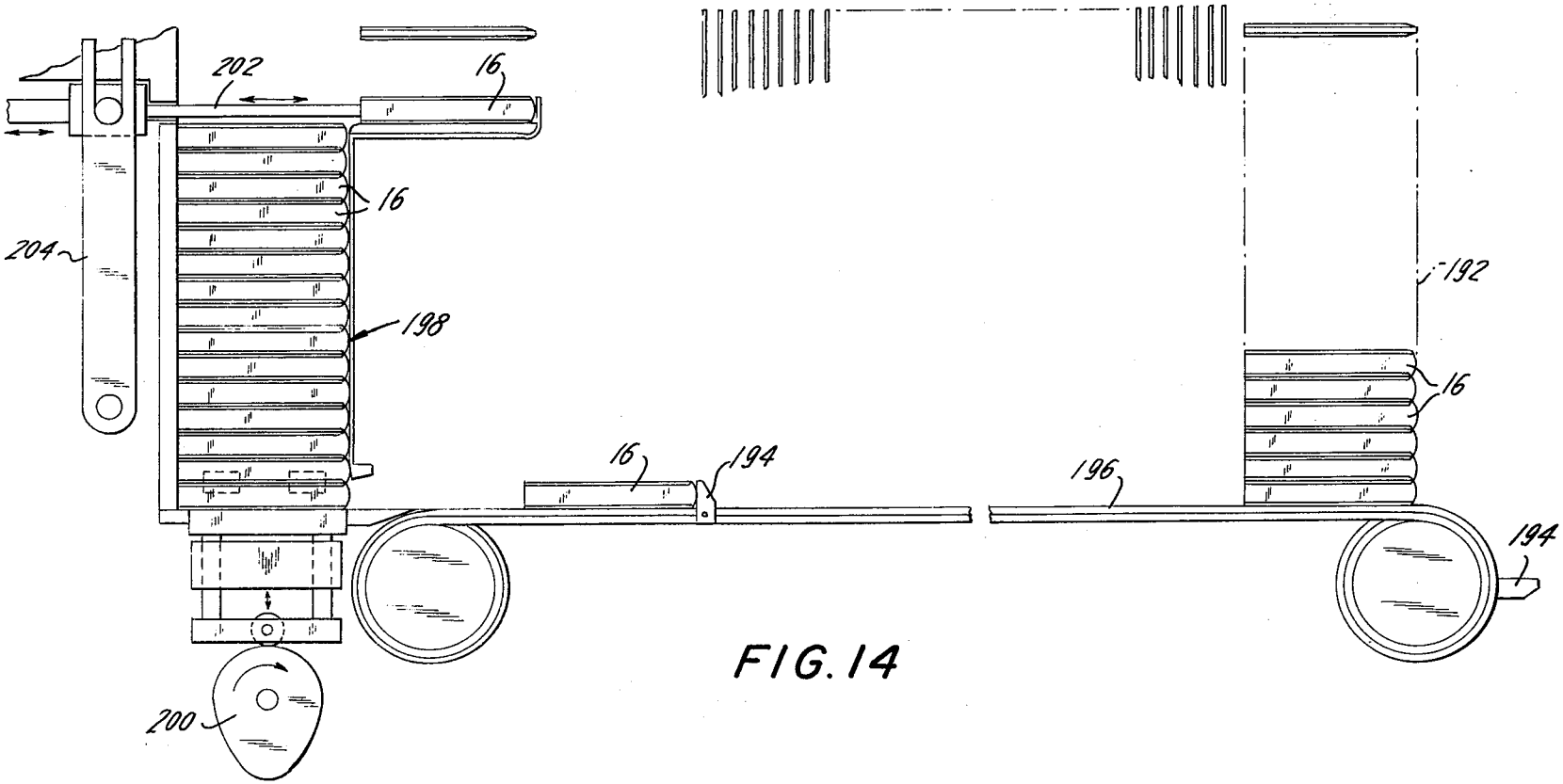
FIG. 14 is a side elevational view, partially broken away, illustrating the details for returning the gripper shuttles from one side of the moving warp sheds to the loading area on the other side of the moving warp sheds.

Referring now to FIGS. 3 and 4, there is shown the details of station 26 for receiving and firing gripper shuttle 16 and a firing mechanism 28. More particularly, a carrying arm 80 is pivotally mounted on a shaft 82 and operates to transfer gripper shuttles 16 from a loading position, shown in dotted lines, to a firing position, shown in solid line. The apparatus for supplying gripper shuttles to the loading position of the carrying arm is shown in FIG. 14 and will be described below.

The firing mechanism 28 includes a firing arm 90 which pivots about a shaft 92 and includes at the upper end thereof a firing head or picking head 94 for engaging the rear end or tail of gripper shuttle 16 and firing same. As will be seen most clearly in FIG. 3, the top of picking head 94 is not higher than and is at substantially the same height as gripper shuttle 16, for a reason to be explained herein.

As shown in FIG. 1, to load the gripper shuttle 16 with weft thread at the firing position, a pin 84 is pivoted upwardly and is inserted into opening 16*a* of gripper shuttle 16 to engage and separate members 16*b* and thereby operate to open the jaws 16*c* of the gripper shuttle 16 against a spring bias, which spring bias operates to close gripper jaws 16*c* upon the retraction of pin 84 from opening 16*a*.

Turning now to FIG. 6, there is shown in greater detail a side elevational view of one of the weft feeders (18) for transferring and guiding weft thread 52 from the weft supply spools 50 to the jaws 16*c* of the gripper shuttle 16. Weft feeder 18 includes spring-biased jaws 18*a* for gripping the weft thread and guides 18*b* about which the weft thread extends. An opening 18*c* is provided for receiving jaw opener 86 (FIG. 1) for actuating jaws 18*a* to their open position.

In operation, as shown in FIG. 1, the feeder jaws 18*a* (FIG. 6) of the weft feeder 18 are closed and carry the weft thread 52 into a position inside the open jaws 16*c* of the gripper shuttle 16. The jaws 18*a* of the weft feeder 18 are then opened by jaw opener 86, and pin 84 is retracted from gripper shuttle 16 so that the gripper jaws 16*c* of the gripper shuttle 16 are closed to grip the weft thread 52 therein. It should be noted that the weft feeder stops its movement for an interval to transfer the weft to the gripper shuttle.

Once the gripper shuttle 16 has been pivoted to firing station 26, and once gripper shuttle 16 has been loaded with weft thread by one of the weft feeders 18, 20, 22, or 24, gripper shuttle 16 is ready to be shot by firing mechanism 28. Firing mechanism 28 pivots forwardly and operates to fire or shoot the gripper shuttle 16 into the synchronizer 30, which operates to impart a lateral movement to gripper shuttle 16 so that it is synchronized with the laterally-moving warp sheds when the gripper shuttle enters the warp shed. Synchronizer 30 includes a plurality of fixed guides 100 and a plurality of movable guides 102 which move relative to fixed guides 100 and define a path of travel through which gripper shuttle 16 is fired. As shown in FIG. 1, movable guides 102 are part of a synchronizer block 104, which is moved laterally by drive shafts 106. Drive shafts 106 are connected to a drive block 108 which is pivoted by a crank arm 111 to impart lateral movement to synchronizer 30. Drive shafts 106 extend through a stationary bearing 112 which is provided with guides 114 for guiding the movement of drive shafts 106. Accordingly, pivoting of crank arm 111 operates to laterally move the movable guides 102 relative to the fixed guides 100.

Figure 5:
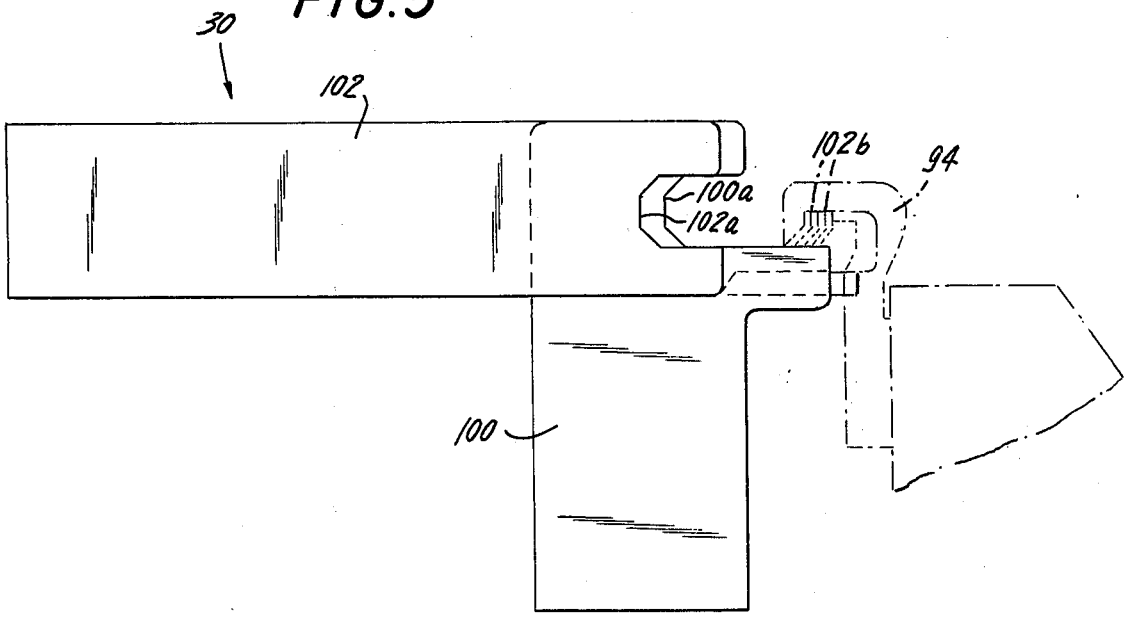
FIG. 5 is a side elevational view of the movable and fixed guides of a synchronizer employed in the present invention.

As shown most clearly in FIG. 5, fixed guides 100 include a rear wall 100*a*, and movable guides 102 also each include rear walls 102*a*. Therefore, a movable guides 102 are moved forward relative to fixed guides 100, the respective walls 100*a* and 102*a* are moved into alignment. Five of the seven movable guides 102 are provided with respective front walls 102*b* in a manner such that each succeeding wall 102*b* in the direction of travel of gripper shuttle 16 is closer to rear wall 102*a* and thereby cooperates to define a narrowing guide path for receiving the gripper shuttle 16 and for imparting to it its lateral movement before it is shot into the moving warp shed 34.

It should also be noted that in the preferred embodiment, a portion of the front vertical wall 80*a* of carrying arm 80 is removed so that when the tail of gripper shuttle 16 has passed wall 80*a*, the nose of gripper shuttle 16 will be in the area of the last fixed guide 100 of synchronizer 30. At that point in time, synchronizer 30 operates to move the movable guides 102 laterally so that the inner walls 102*a* of the movable guides engage and impart to the gripper shuttle 16 its lateral movement to synchronize the gripper shuttle with the lateral movement of the moving warp shed 34. In addition, it should also be noted that movable guides 102 begin to move laterally before the gripper shuttle has completely entered the synchronizer 30, so that when the movable guide walls 102*a* do engage the gripper shuttle, the movable guides are moving laterally at the desired speed so that the gripper shuttle is imparted the desired lateral speed which will synchronize it with the moving warp shed 34.

Referring now to FIGS. 1 and 7, the movement and operation of the weft feeders and guides 18, 20, 22, and 24 will now be described. Each weft feeder and guide moves in a substantially closed path 110 (as shown in FIG. 1) and follows the lateral movement of its associated gripper shuttle 16 so that the fast-moving gripper shuttle 16 may freely pull the weft thread through the associated moving warp shed. The weft feeder operates to maintain the weft thread directly behind and in line with the laterally-moving gripper shuttle as it traverses the laterally-moving warp sheds. In this manner, each weft feeder continues to move laterally and toward the warp yarns and follows its associated shed 34, 36, or 38 and gripper shuttle 16 while the respective gripper 16 traverses its associated shed and emerges from the far side of the shed, is stopped and backed up slightly in a manner to be explained, and the weft tension is adjusted by tensioning apparatus 54, 56 in a manner as explained above. More particularly, as shown in FIG. 1, when gripper shuttle 16 is at firing station 26, weft feeder 18 is supplying the weft thread thereto. The gripper shuttle 16, which was previously fired into moving warp shed 36, is being followed by weft feeder 20 along the forward leg of the closed path 110. Similarly, gripper shuttle 16, which was previously fired, has substantially traversed warp shed 38 and is being followed by weft feeder 22 as it continues to move along the forward leg of closed path 110. It should be noted that as the weft feeders 20 and 22 move along the forward leg of path 110, the weft thread is located on the front side of these weft feeders so that they guide the weft threads to follow the laterally-moving gripper shuttles and moving warp sheds, with the lateral speed of the weft feeders and weft threads being synchronized with the lateral movement of the moving warp sheds and gripper shuttles.

As shown in FIG. 1, a clamp 187 operates to grasp the weft thread of weft feeder 22 and moves parallel to the edge of the warp threads toward the fell of the cloth 48. The weft thread, which is held by clamp 187, is in a position to be grasped by the jaws of the weft feeder, which jaws are actuated to grasp the weft thread by pin 189. As is well known, the pin 189 reciprocates in a timed sequence so that the weft feeder jaws operate to grasp the weft thread prior to cutting. Then, the weft thread is cut by cutter 188 and is held a short distance beyond the warp shed by clamp 187. On the other side of the loom, clamp 186 also operates to clamp the other end of the weft when it is released from the gripper shuttle. Then, clamps 186, 187 continue to move toward the fell of the cloth synchronously with the weft as beat-up progresses and can cooperate with a tucking device for tucking in the ends of the weft thread in a known manner.

As shown in FIG. 1, receding weft feeder 24, grasping the cut end of the weft thread, which is connected to one of the weft supply spools 50, moves along its closed path 110 away from the moving warp sheds. As weft feeder 24 retreats along the rear leg of path 110, in a direction towards the weft supply spools, compensation assembly 54 operates to take up the slack produced in the weft thread. Weft feeder 24 continues its return along the path as indicated and at the speed required to be in a position to feed the weft to another gripper shuttle 16 which is brought into position at firing station 26.

Accordingly, in the system shown, there are always two gripper shuttles 16 actively inserting and laying weft thread in moving warp sheds 36 and 38, with the system utilizing four weft feeders and four weft supply spools, as shown. It should be clear that a larger number of active gripper shuttles 16 could be used in accordance with the present invention. It would only be necessary to adapt the weft feeder system to supply a larger number of gripper shuttles by adding additional weft supply spools and weft feeders.

Referring now to FIG. 7, the operation of a weft guide pin 120 is explained, which weft guide pin is located between firing station 26 and synchronizer 30, as shown in FIG. 1. Weft guide pin 120 is raised by a cam 122 and follower 124 through a guide and support 126. The weft guide pin 120 is raised just after the gripper shuttle 16 passes it, and after picking head 94 moves to its forwardmost position. Weft guide pin 120 operates to lift the weft thread slightly so that it passes over the picking head 94 as the associated weft feeder, gripper shuttle, and moving shed guides move in their lateral direction so that the weft thread which extends between the weft feeder and gripper shuttle avoids interference with the picking head 94. Weft guide pin 120 remains in its raised position above the picking head 94 until picking head 94 passes guide pin 120 on its return to its picking position for firing the next gripper shuttle.

Figure 9:
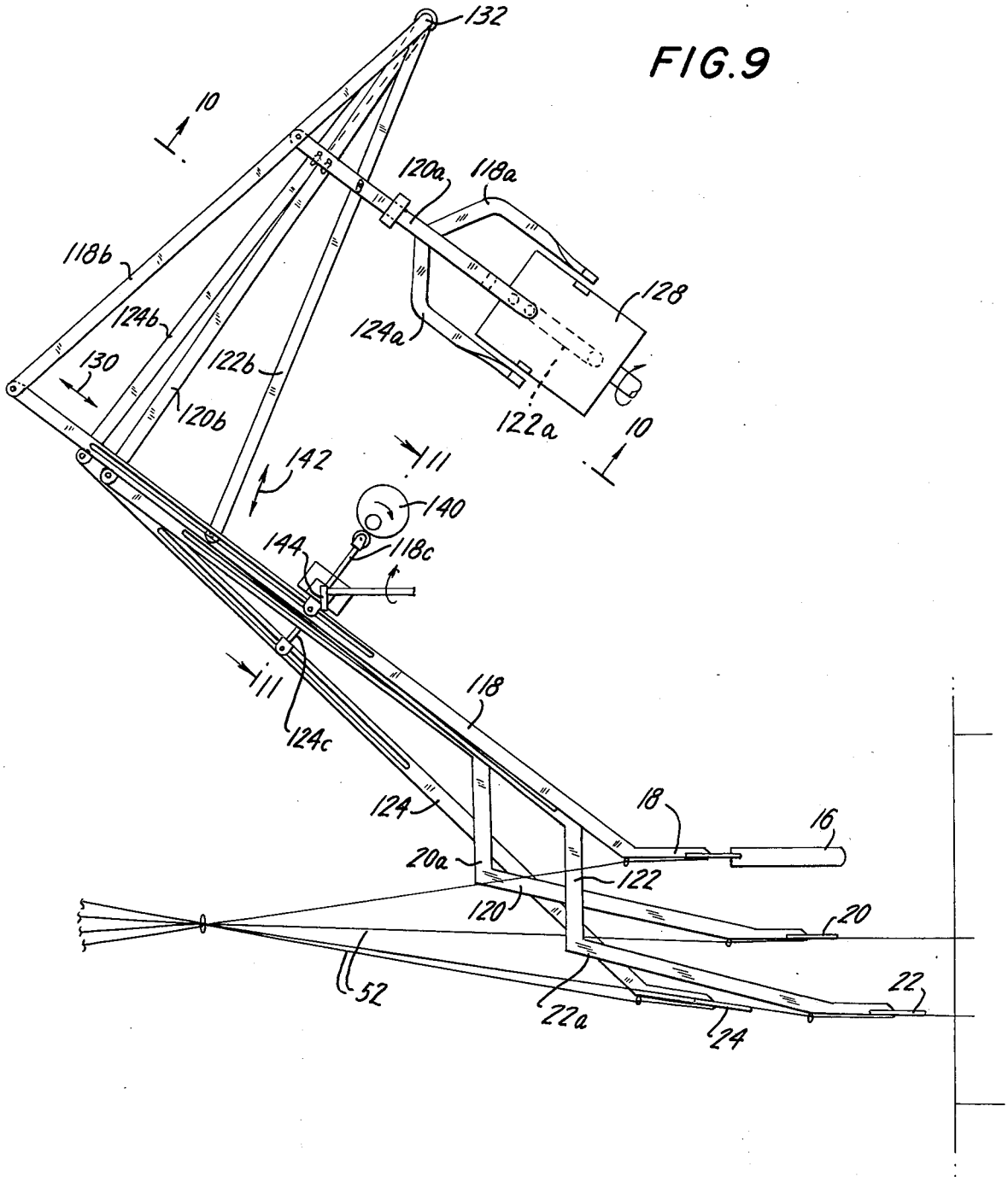
FIG. 9 is a plan view of the control apparatus for controlling the movement of the weft feeders and guides of the present invention.

Turning now to FIG. 9, there is shown each of the weft feeders 18, 20, 22, and 24 in plan view and their attachment to their respective actuating arms, which cause each of the weft feeders to move through their respective closed paths. It should first be noted that the respective actuating arms 120 and 122 for weft feeders 20 and 22 are provided with elbows or angled portions 20*a* and 22*a* so that their respective movement through their closed paths would not interfere with each other and with the actuating arms 118 and 124 of the other weft feeders 18 and 24. In addition, in order to avoid interference between the respective actuating arms and threads of each of the weft feeders as they move through their paths, control apparatus to be described is provided for controlling the movement of each of the weft feeders. More particularly, weft feeders 20 and 22 move in a substantially horizontal plane. However, weft feeder 18, during its movement along the forward leg of path 110, is in a substantially horizontal plane, but is then moved upwardly above its operating plane during its return movement along the rear leg of the path. Weft feeder 24 also moves in a substantially horizontal plane during its movement along the forward leg of path 110, but weft feeder 24 is then moved downwardly below its operating plane during its return movement along the rear leg of path 110. In this manner, interference between the respective actuating arms and threads of each of the weft feeders is avoided.

Figure 10:
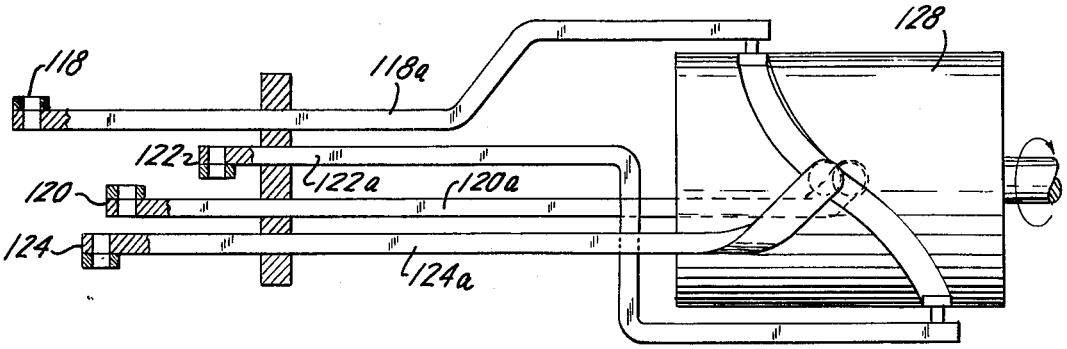
FIG. 10 is a detailed section along 10—10 of FIG. 9, illustrating the details of a cam and follower arrangement for controlling the movement of the weft feeders and guides.

Turning now to FIG. 9, there shown the control apparatus for controlling the movement of each of the weft feeders 18, 20, 22, and 24 along the respective paths and planes described in the foregoing paragraph. As shown in FIGS. 9 and 10, cam 128 operates to control the movement of actuating arms 118, 120, 122, and 124 in the back and forth direction, illustrated by double-headed arrow 130. Cam 128 controls the movement of cam followers 118*a*, 120*a*, 122*a*, and 124*a*, which are pivotally connected to respective links 118*b*, 120*b*, 122*b*, and 124*b*, each of said links being pivoted about a point 132. As shown, each of the links are pivotally connected to the respective actuating arms 118, 120, 122, and 124.

Figure 11:
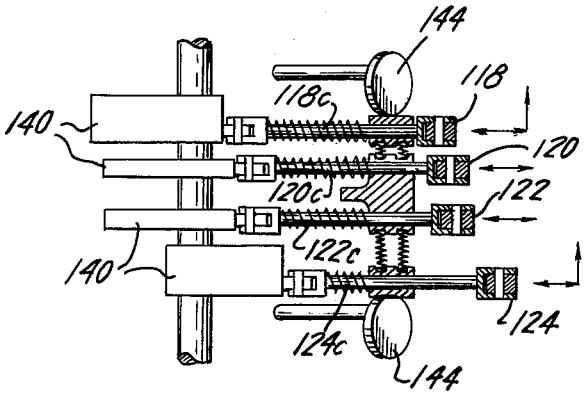
FIG. 11 is a sectional view taken along 11—11 of FIG. 9, illustrating in detail a cam and follower arrangement for controlling the movement of the weft feeders and guides of the present invention.

As also shown in FIGS. 9 and 11, a series of cams 140 operates to control the movement of the respective actuating arms 118, 120, 122, and 124 in a side-to-side direction, as represented by double-headed arrow 142. Cam 140 controls cam followers 118*c*, 120*c*, 122*c*, and 124*c*, which are each pivotally connected to the respective actuating arms 118, 120, 122, and 124 for controlling the side-to-side movement of the respective weft feeders. It should be noted that slots are provided in the actuating arms to allow the arms to move relative to cam arrangement 140.

In addition, weft feeders 18 and 24 are caused to move in a direction into and out of the paper by cam members 144 shown most clearly in FIG. 11. Accordingly, by controlling the movement of the weft feeders in the foregoing manner, interference between the respective actuating arms and threads of each of the weft feeders is avoided, and the movement of the weft feeders is controlled in all three dimensions, as well as in timed relation with each other.

Figure 12:
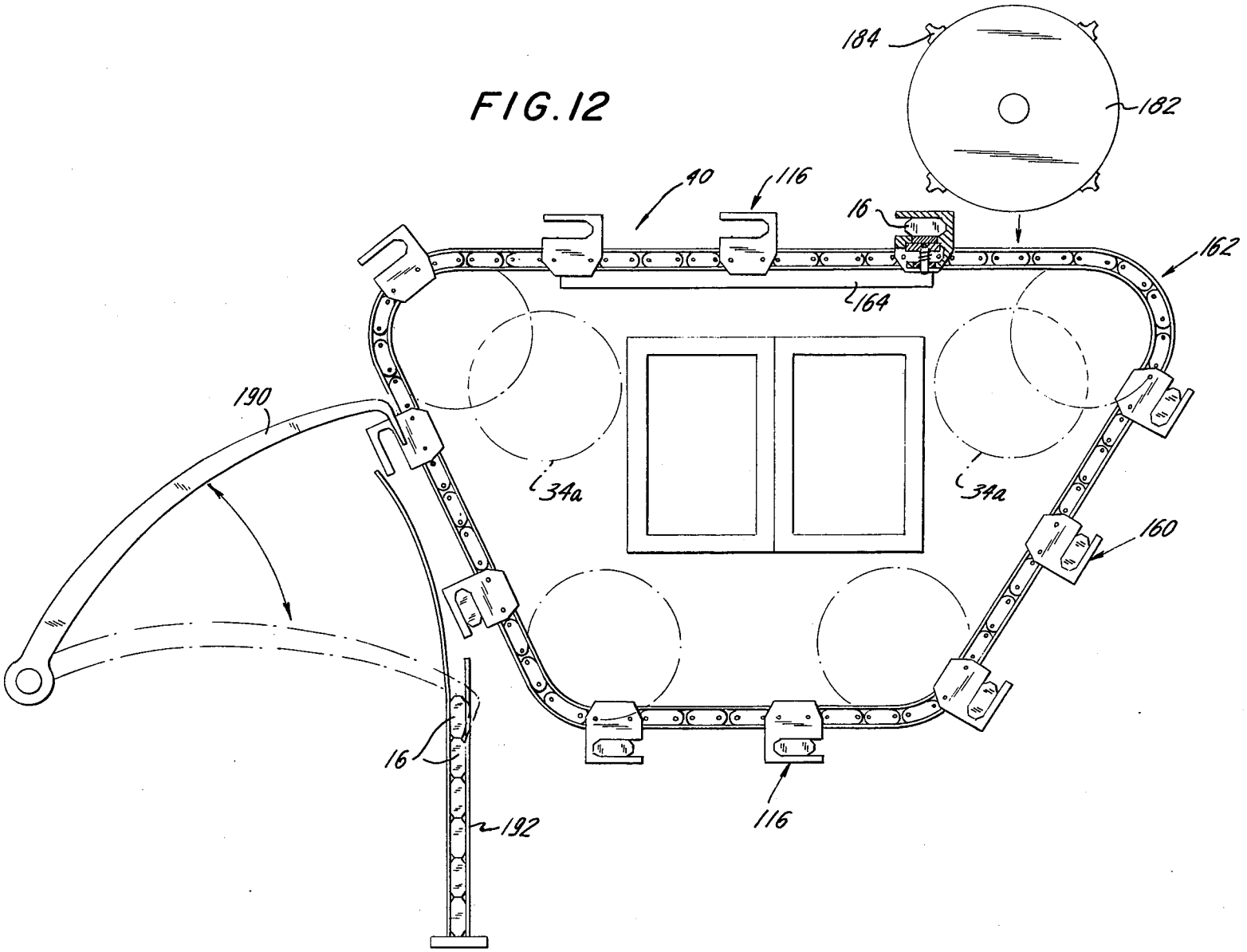
FIG. 12 is a side elevational view of the receiving and stopping station for the gripper shuttles at a receiving area on one side of the moving warp sheds, which operates to receive and stop the gripper shuttles as they emerge from the moving warp sheds.

Turning now to FIG. 12, there is shown in detail the receiving station 40 for receiving and stopping gripper shuttles 16 as they emerge from the respective warp sheds 34, 36, 38. More particularly, the receiving station 40 includes a plurality of catchers 160 for receiving and stopping the gripper shuttles 16. The gripper catchers 160 are mounted on a rotating conveyor 162 which moves in synchronism with the moving warp sheds 34, 39, and 38 and receives the gripper shuttles 16 as they emerge from the moving warp sheds. The drive shafts 34*a* for moving warp shed 34 are shown in FIG. 12. A pair of parallel rails 164 are mounted below the gripper catchers 160 and operate to apply a braking action to the gripper catchers 160 during the entire time the gripper shuttle 16 is traversing the warp shed so that the machine can be stopped at any time after the gripper shuttle is fired and still operates to receive the gripper shuttle.

Figure 13:
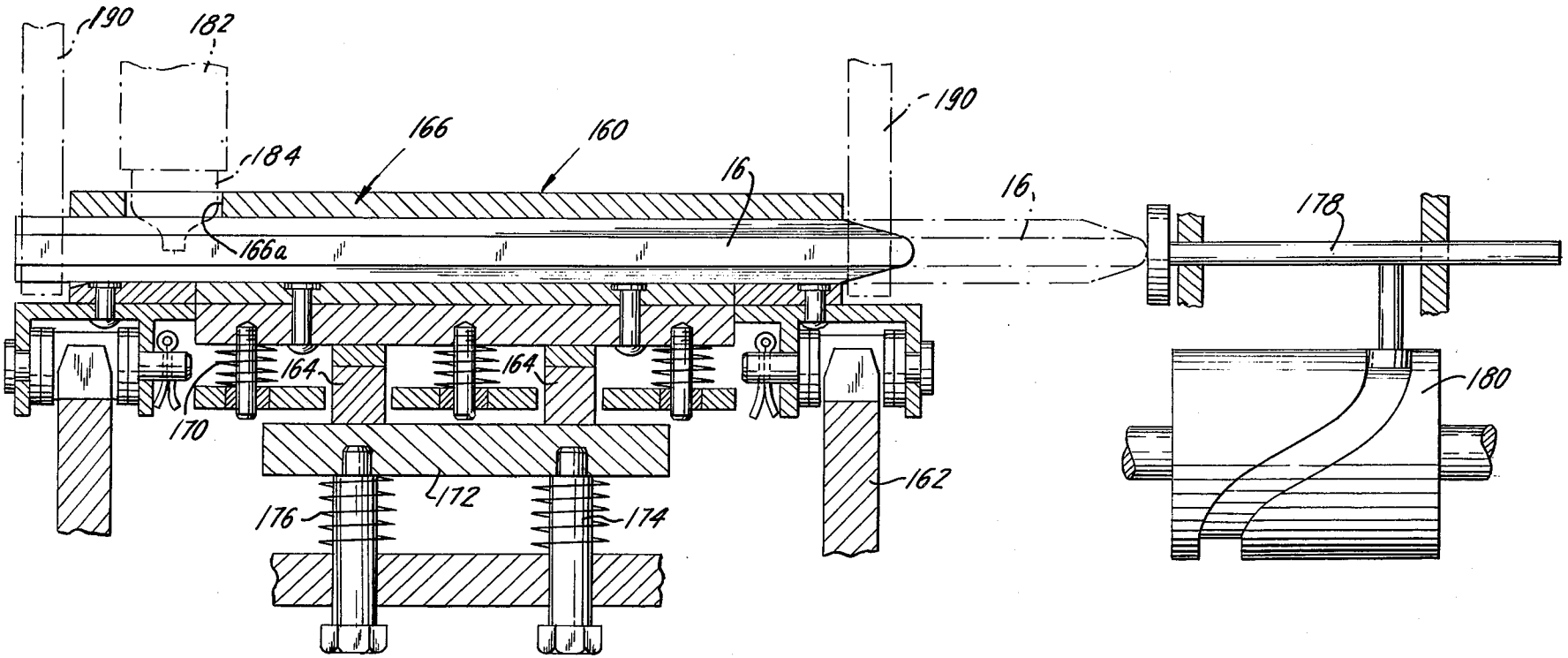
FIG. 13 is a sectional view illustrating in detail one of the gripper catchers of said receiving and stopping stations.

The details of gripper catchers 160 are shown in greater detail in FIG. 13. More particularly, each gripper catcher 160 includes a housing 166 for receiving and stopping the gripper shuttle 16. A floor 168 of housing 166 defines a braking surface which is actuated by rails 164. Springs 170 provide an auxiliary braking action to floor 168 after the gripper catcher 160 passes rails 164. In addition, the degree of braking action may be adjusted. More particularly, rails 164 are connected to a lower member 172, which is adapted to receive threaded members 174, having springs 176 thereon. By adjusting threaded members 174, the amount of braking action that rails 164 apply to floor 168 of housing 166 may be adjusted, if desired.

Accordingly, as can be seen more clearly in FIG. 12, as gripper catchers 160 are brought into position over rails 164 by rotation of conveyor 162, the rails 164 operate to apply the braking action to the gripper catchers 160 so that they operate to receive and stop the gripper shuttles 16 as they emerge from the moving warp sheds. As shown in FIG. 13, the gripper shuttle 16 may travel beyond the housing 166 so that its nose portion extends out of the housing 166, as shown by the representation of gripper shuttle 16 in dotted lines. Accordingly, a reciprocating arm 178, controlled by a cam 180, operates to push the gripper shuttle 16 into housing 166 so that it is properly positioned therein. Then, as shown in FIGS. 12 and 13, a rotating wheel 182, having pins 184 mounted thereon, enters an opening 166*a* in the ceiling of housing 166. With the gripper shuttle 16 properly positioned in housing 166, pin 184 also enters opening 16*a* of gripper shuttle 16 to release the gripper jaws 16*c* and thereby release the weft thread from the gripper shuttle 16. It should be noted that pin 184 operates to release the weft thread from gripper shuttle 16 just after clamp 186 (see FIG. 1) grips the weft thread.

As shown in FIG. 12, as conveyor 162 continues to rotate, gripper catchers 160 move off of rails 164 and the amount of pressure applied to the floor 168 of housing 166 is decreased, and housing 166 then merely operates to hold the gripper shuttles in position within the gripper catcher 160. Then, as conveyor 162 continues to rotate, gripper catchers 160 operate to move gripper shuttles 16 to a position where a pair of pivoting fingers 190 operate to eject successive gripper shuttles 16 from the gripper catchers 160 as they are each moved into position adjacent the pivoting fingers 190. As shown most clearly in FIG. 13, pivoting fingers 190 operate to engage the nose and tail of gripper shuttle 16, which extends beyond housing 166 so that it may be ejected therefrom. As shown in FIG. 12, at that point, the gripper shuttles 16 are supplied to a receiving chute 192 for returning the gripper shuttles 16 to firing station 26.

The manner of returning gripper shuttles 16 from chute 192 to firing station 26 is shown in detail in FIG. 14. More particularly, the gripper shuttle 16 at the bottom of the stack in chute 192 is contacted by one of a series of lugs 194 mounted on a chain conveyor 196, which transports gripper shuttles 16 to the picking side of the loom. At that position, the gripper shuttle 16 is inserted into the bottom of a magazine 198. A cam 200 operates to shift the stack of gripper shuttles 16 in magazine 198 upwardly to allow the gripper shuttle 16 being returned by lug 194 to take its position at the bottom of the magazine. At the top of magazine 198, a reciprocating arm 202, operated by a crank 204, engages the topmost gripper shuttle 16 in timed relation to the pivoting motion of carrying arm 80 in order to insert the gripper shuttle 16 into the carrying arm 80 when it is in its lowermost position. In this manner, carrying arm 80 then pivots upwardly with gripper shuttle 16 to move it into position at firing station 26.

When the carrying arm 80 moves this gripper shuttle 16 into firing station 26, as shown in FIG. 1, pin 84 operates to open the jaws 16c of gripper shuttle 16 for receiving the weft thread from a weft feeder. When the carrying arm 80 and gripper shuttle 16 are in this picking position ready to be fired, a weft feeder is in position to enter the jaws 16c of the gripper shuttle 16 with the end of the weft thread and remain there while the pin 84 is retracted and allows the gripper jaws 16c to close upon the weft thread. Then, jaw opener 86 operates to open the jaws of the weft feeder so that the gripper shuttle 16 is ready to be fired through synchronizer 30 and into one of the moving warp sheds 34, 36, or 38, in a manner described above.

DETAILED DISCUSSION OF SECOND EMBODIMENT OF THE INVENTION

Figure 15:
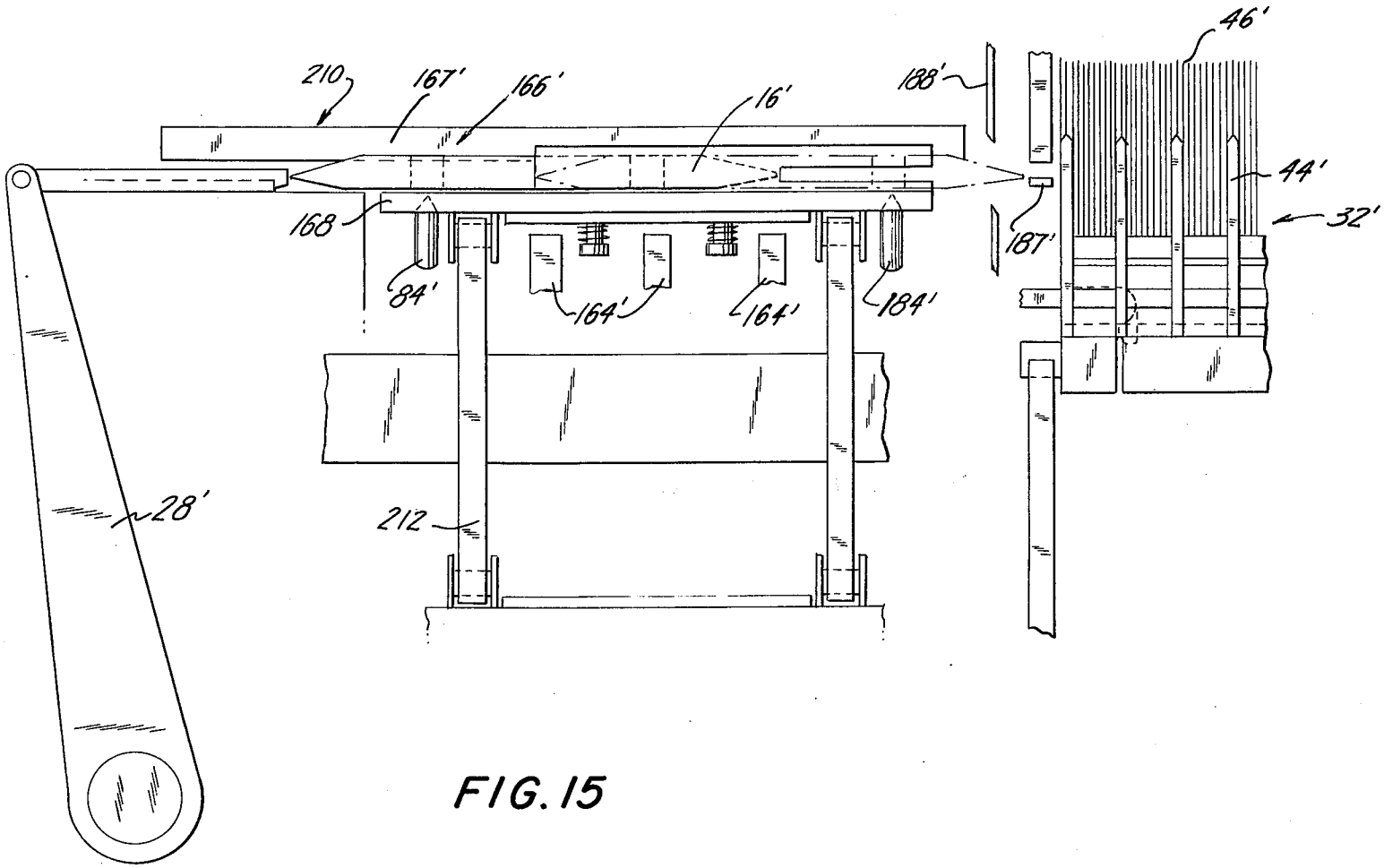
FIG. 15 is a side elevational view illustrating a second embodiment employing the concepts of the present invention and illustrates a station for firing and receiving gripper shuttles.

Referring now to FIG. 15, there is shown a modified form of the present invention for inserting weft thread in a warp-wave weaving loom, generally designated by the reference numeral 210. In this embodiment, the synchronizer is in the form of a rotating conveyor 212, whose movement is synchronized with the moving warp sheds of the warp-wave weaving loom 32'. For purposes of convenience, components in this embodiment, which are similar to those of the first embodiment, will be assigned a like reference numeral and designated with a prime. Although not shown in the drawing, a similar conveyor 212 is arranged on the opposite side of the warp-wave weaving loom 32'. Each of the conveyors 212 is provided with a series of housings 166' for receiving gripper shuttles 16' as they emerge from the warp-wave weaving loom 32', and which housings 166' also operate to fire gripper shuttles 16' through the moving warp sheds of the warp-wave weaving loom 32'. In this manner, alternate housings 166' on each conveyor 212 operate to fire a gripper shuttle 16 while the remaining housings 166' operate to receive and stop gripper shuttles 16', which have been fired from the conveyor 212 on the other side of the loom 32'.

As shown in FIG. 15, there is a firing mechanism 28', which operates to fire gripper shuttle 16' from housing 166' to the other side of the loom 32' so that it is received by a like housing 166' mounted on the conveyor 212 on the other side of the loom. In addition, cams 164' are provided for imparting a braking action to housings 166' to receive and stop gripper shuttles 16' fired from the other side of the loom 32'. It should also be noted that after gripper shuttle 16' is received in housing 166', a stationary cam operates to push gripper shuttle 16' into the proper position for receiving pin 184 for releasing the weft thread from the gripper shuttle 16', after clamp 187' has closed to grip the weft thread. Clamp 186' and the clamping jaws of the weft feeder, located on the other side of the loom, operate to grip the weft thread. A corresponding cutter 188' on the other side of the loom then operates to cut the weft thread.

Figure 16:
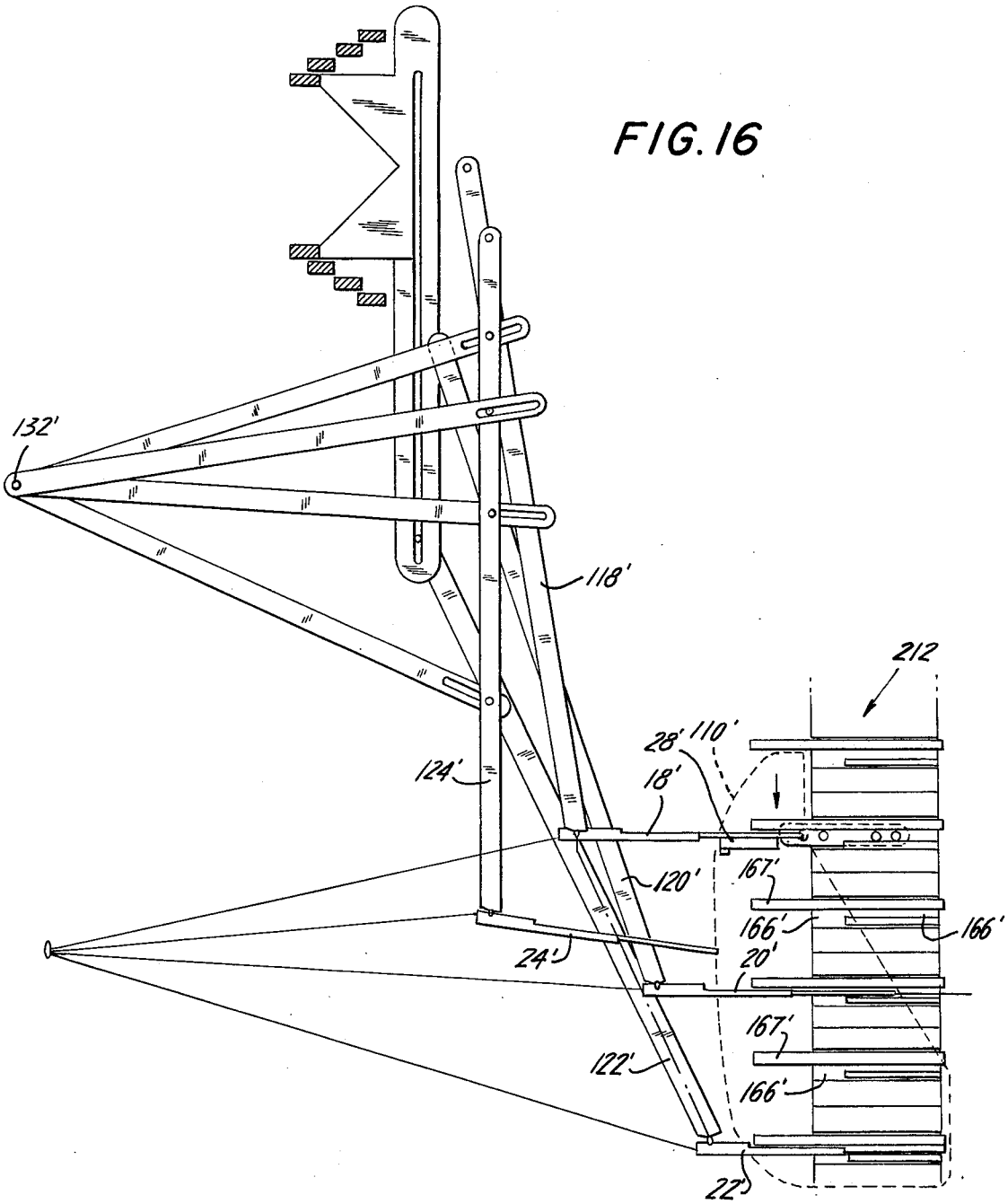
FIG. 16 also relates to the second embodiment and is a plan view of the control apparatus for moving the weft feeders relative to the housings for firing and receiving gripper shuttles.
Figure 18:
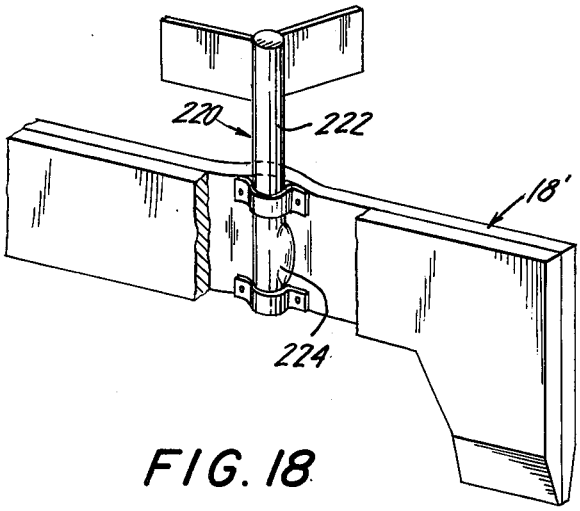
FIG. 18 is a detailed view illustrating the means for opening and closing the gripper jaws of one of the weft feeders of the second embodiment.

Turning now to FIG. 16, there is shown in plan view the conveyor 212 and the housings 166' mounted thereon and the weft feeders 18', 20', 22', and 24', which are controlled to operate in a manner similar to that of the first embodiment. Continuing with the above-described operation, after the weft thread is cut, weft feeder 22' is retracted from housing 166', and the housing continues to move with conveyor 212. At the bottom of the conveyor, there is a stationary cam (not shown), which operates to push the nose of gripper shuttle 16' into its proper position in housing 166' so that it is ready to receive the weft thread from the next weft feeder and will be ready to be fired into one of the moving warp sheds. More particularly, as shown in FIG. 16, while gripper shuttle 16' is moving between positions A and B, a transfer of weft thread is taking place from weft feeder 18' to the gripper shuttle 16', in a manner to be explained more clearly with respect to FIGS. 18 and 19.

As will also be seen in FIG. 16, after the gripper shuttle 16' is fired, the weft feeder follows the movement of the gripper shuttle and enters the housing 166'. (See weft feeder 20' partially inserted into one of the housings 166'.) As weft feeder 20' continues to move to the left with conveyor 212, as shown in FIG. 16, the weft feeder continues to extend further into housing 166' until it reaches the position illustrated by weft feeder 22'. However, as explained above, before weft feeder 22' reaches this position, clamp 186' closes to engage one end of the weft thread, and the gripper jaws of weft feeder 22' also close to clamp the weft thread on the other end, so that it can be cut. It should be noted that the clamping occurs after the gripper shuttle has been caught and backed up to its proper position and the weft thread has been properly tensioned. Once the weft thread is cut, weft feeder 22' is free to return through its closed path, as shown by weft feeder 24', until it again reaches the loading station for supplying the end of the weft thread to the next gripper shuttle 16', as represented by weft feeder 18'.

It should also be noted that housings 166' include members 167', which extend out of the housings, so that they engage the weft feeders during their entry into the housings 166'. In this manner, members 167' operate to cause the weft feeders to pivot relative to their respective actuating arms 118', 120', 122', and 124'.

Figure 17:
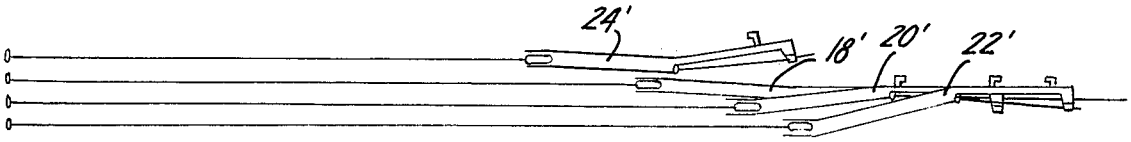
FIG. 17 is a diagrammatic view in side elevation of the relative positions of the weft feeders employed in the second embodiment.

Referring now to FIG. 17, the weft feeders 18', 20', 22', and 24' are shown in side elevation to illustrate their relative positions. As can be seen, each of the weft feeders includes gripper actuating member 220 for controlling the opening and closing of the jaws of the respective weft feeders. More particularly, as shown in greater detail in FIGS. 18 and 19, weft feeder 18', for example, operates to insert the weft thread into gripper shuttle 16' from above. As shown most clearly in FIG. 18, member 220 operates to pivot 90° and is attached to a shaft 222, which rotates a caming member 224. The caming member 224, on upon being rotated by member 220, operates to open the jaws of weft feeder 18' in cooperation with the opening of the jaws of gripper shuttle 16' so that weft thread is supplied to the gripper shuttle 16'. Actuation of member 220 is brought about by engaging a suitable stationary cam member (not shown).

Figure 19:
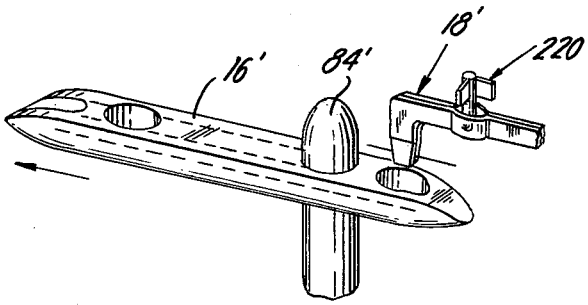
FIG. 19 is a perspective view illustrating in detail the gripper shuttle employed in the second embodiment of the present invention.

As shown in FIG. 19, jaw opener 84' enters gripper shuttle 16' to open its jaws for receiving the weft thread from the weft feeder 18'. Once the weft thread is transferred to the gripper shuttle 16', it is ready to be fired from housing 166' by firing mechanism 28', in the manner explained above.

It should be noted that in the second embodiment, at any given time there are three gripper shuttles 16' traversing the moving warp sheds. Two of the gripper shuttles will have been fired from the conveyor 212 on one side of the loom, and the other gripper shuttle will have been fired on the other conveyor 212 on the other side of the loom. Of course, it should be understood that the number of shuttles traversing the sheds at any given time can be increased in accordance with this invention by providing a different timing sequence. In addition, it should also be noted that the picking head on one side of the loom can be staggered with respect to the picking head on the other side of the loom, so that both picking heads can operate to simultaneously fire gripper shuttles into different ones of the moving warp sheds.

A latitude of modification, change, and substitution is intended in the foregoing disclosure and, in some instances, some features of the invention will be employed without a corresponding use of other features. Accordingly, it is appropriate that the appended claims be construed broadly and in a manner consistent with the spirit and scope of the invention herein.

What is claimed is:

1. In a weaving loom utilizing a plurality of moving warp sheds, wherein the sheds move in the direction of the warp threads so that said sheds move in a longitudinal direction, the method of supplying and laying weft threads in each of said moving sheds comprising the steps of:

moving a gripper shuttle into a loading area on at least one side of said moving warp sheds, supplying weft thread to said loading area from a plurality of stationary weft supply packages, said gripper shuttle operating to grip said weft thread, firing said gripper shuttle with the gripped weft thread through one of said moving warp sheds, said gripper shuttle being unconnected to said loom during its traversal through said one of said moving warp sheds, and receiving and stopping said gripper shuttle at a receiving area on the other side of said moving warp sheds, whereby weft thread is laid in said one of said moving warp sheds during the entire time said gripper shuttle traverses said moving warp shed.

2. The method of claim 1 further including the step of returning said fired gripper shuttle to said loading area via a path other than through said moving warp sheds.

3. The method in accordance with claim 1 further including the step of imparting longitudinal motion to said gripper shuttle so that while said gripper shuttle moves through said moving warp shed, it also moves in said longitudinal direction.

4. A method in accordance with claim 3 further including the step of guiding each of said weft threads to follow the longitudinal movement of its associated gripper shuttle during its traversal through its associated moving shed.

5. The method of claim 3 further including the step of synchronizing the longitudinal speed of said gripper shuttle with the longitudinal speed of said moving warp sheds before said gripper shuttle enters one of said moving warp sheds.

6. A method in accordance with claim 1 further including the step of controlling the tension of said weft thread during the traversal of said gripper shuttle through said one of said moving sheds.

7. The method of claim 1 further including the step of clamping the weft thread on both sides of said loom.

8. The method of claim 1 further including the step of releasing the weft thread from said gripper shuttle at said receiving area.

9. The method of claim 1 further including the step of firing one gripper shuttle into each of said warp sheds so that at any given time one or more gripper shuttles are laying weft threads into said moving warp sheds.

10. The method of claim 1 further including the step of firing a second gripper shuttle with weft thread gripped therein through a second one of said moving warp sheds, while said first gripper shuttle is still traversing said first one of said moving warp sheds.

11. The method of claim 10 further including the step of firing a third gripper shuttle with weft thread gripped therein through a third one of said moving warp sheds, while said first and second gripper shuttles are still traversing through said first and second moving warp sheds.

12. In a weaving loom utilizing a plurality of moving warp sheds, wherein the sheds move in the direction of the warp threads so that said sheds move in a longitudinal direction, apparatus for supplying and laying weft threads in each of said moving sheds successively, comprising:

means for moving a gripper shuttle into a loading area on at least one side of said moving warp sheds, means for transferring weft thread to said gripper shuttle from a plurality of stationary weft supply packages, means for firing said first gripper shuttle with the gripped weft thread through a first one of said moving warp sheds, said gripper shuttle being unconnected to said loom during its traversal through said first one of said moving warp sheds, and means for receiving and stopping said gripper shuttle at a receiving area on the other side of said moving warp sheds, whereby weft thread is laid in said first one of said moving warp sheds during the entire time that said gripper shuttle traverses said first moving warp shed.

13. Apparatus in accordance with claim 12, further including means for clamping said weft thread on both sides of said loom after said gripper shuttle and weft thread emerge from one of said moving warp sheds.

14. Apparatus in accordance with claim 12, further including means for imparting longitudinal motion to said gripper shuttle so that while said gripper shuttle moves through said moving warp shed, it also moves in said longitudinal direction.

15. Apparatus in accordance with claim 14, further including means for synchronizing the longitudinal speed of said gripper shuttle with the longitudinal speed of said moving warp sheds before said gripper shuttle enters one of said moving warp sheds.

16. Apparatus in accordance with claim 15, wherein said synchronizing means includes conveyor-mounted housings for moving said gripper shuttles at a speed in timed relation with the speed of said moving warp sheds.

17. Apparatus in accordance with claim 15, wherein said synchronizing means includes a plurality of interlineated movable and fixed guides, which cooperate to define a path of travel for said gripper shuttle prior to entry into said moving warp sheds, said movable guides including means for imparting a direction of movement to said gripper shuttle, said direction of movement being perpendicular to the direction that said gripper shuttle is initially fired.

18. Apparatus in accordance with claim 14, wherein said transferring means includes means for guiding each of said plurality of weft threads to follow the longitudinal movement of its associated gripper shuttle during said gripper shuttles traversal through its associated moving shed.

19. The apparatus of claim 12, further including means for returning said first gripper shuttle to said loading area via a path, other than through said moving warp sheds.

20. Apparatus in accordance with claim 19, wherein said means for returning said gripper shuttle to said loading area includes conveyor-mounted lugs for pushing said gripper shuttles from one side of said moving warp sheds to the other side thereof.

21. The apparatus of claim 12, wherein the means for transferring weft thread to said loading area includes means for supplying weft threads from a plurality of stationary weft spools and for transferring said plurality of weft threads from said plurality of spools to gripper shuttles at said loading area.

22. Apparatus in accordance with claim 21 further including means for controlling the tension of one or more weft threads during the traversal of one or more gripper shuttles through said moving warp sheds.

23. Apparatus in accordance with claim 21, wherein said means for transferring said plurality of weft threads includes a plurality of weft feeders and guides.

24. Apparatus in accordance with claim 23 further including means for controlling the movement of said weft feeders and guides to define a closed path of movement.

25. Apparatus in accordance with claim 24, wherein said means for controlling the movement of said weft feeders includes first means for actuating said weft feeders in a first direction and second means for actuating said weft feeders in a second direction and third means for actuating said weft feeders in a third direction.

26. Apparatus in accordance with claim 25, wherein said first and second actuating means for actuating said weft feeders includes a plurality of actuating arms connected to said respective weft feeders, and a plurality of cams and followers for controlling the movement of said respective actuating arms.

27. Apparatus in accordance with claim 26, where at least one of said actuating arms of said respective weft feeders includes an elbow configuration so that interference between the movement of said respective actuating arms is avoided.

28. Apparatus in accordance with claim 12, further including means for releasing the weft thread from said gripper shuttle at said receiving area.

29. Apparatus in accordance with claim 12, wherein said means for moving a gripper shuttle into said loading area includes a pivoting carrying member for receiving said gripper shuttle at a first position and for transferring said gripper shuttle to a second position for firing.

30. Apparatus in accordance with claim 12, wherein said means for moving said gripper shuttle into said loading area includes a conveyor-mounted housing.

31. Apparatus in accordance with claim 12, further including means for actuating said gripper shuttle to grip said weft thread at said loading area.

32. Apparatus in accordance with claim 12, wherein said firing means includes a firing pin, said firing means being substantially at the same height as said gripper shuttle in its firing position.

33. Apparatus in accordance with claim 12, wherein said receiving and stopping means includes a plurality of conveyor-mounted housings for receiving and stopping said gripper shuttles as they emerge from said moving warp sheds.

34. In a weaving loom utilizing a plurality of moving warp sheds, wherein the sheds move in the direction of the warp threads so that said sheds move in a longitudinal direction, the method of supplying and laying weft threads in each of said moving sheds, comprising the steps of:

transferring a weft thread to a gripper shuttle, firing said gripper shuttle with the gripped weft thread through one of said moving warp sheds so that while said gripper shuttle traverses said moving warp shed, it also moves in said longitudinal direction, and guiding said weft thread to follow the longitudinal movement of its associated gripper shuttle during its traversal through its associated moving warp shed.

35. The method of claim 34, wherein the step of transferring a weft thread includes the step of supplying weft threads from a plurality of stationary weft supply packages to a plurality of gripper shuttles.

36. The method of claim 34 further including the step of receiving and stopping said gripper shuttle at a receiving area on the other side of said moving warp sheds.

37. The method of claim 36 further including the step of returning said gripper shuttle from said receiving area to a loading area to receive another weft thread.

38. The method of claim 34, wherein the step of firing includes the step of firing one gripper shuttle into each of said moving warp sheds so that at any given time, one or more gripper shuttles are laying weft threads in said moving warp sheds.

39. In a weaving loom utilizing a plurality of moving warp sheds, wherein the sheds move in the direction of the warp threads in a substantially straight plane toward the fell of the textile product, the method of supplying and laying weft threads in each of said moving warp sheds, comprising the steps of:

moving a first gripper shuttle into a loading area on at least one side of said moving warp sheds for receiving and gripping weft thread, and firing said first gripper shuttle carrying weft thread through one of said moving warp sheds while a second gripper shuttle is still traversing another one of said moving warp sheds carrying weft thread therethrough and while a third gripper shuttle is being moved into said loading area.

40. A method of weaving utilizing a plurality of warp threads and weft threads, comprising the steps of:

forming and retaining sheds in said warp threads, moving said sheds in a direction longitudinal to the warp threads, supplying weft thread to weft-insertion means from stationary weft supply packages located outside of said moving warp sheds by weft supplying means, and continuously inserting said weft threads into said moving warp sheds by said weft-insertion means.

41. The method of claim 40, wherein the step of inserting weft thread includes inserting said weft thread into said moving warp sheds with gripper shuttles.

42. The method of claim 40 further including the step of guiding said weft threads to follow the movement of said moving warp sheds during the traversal of said weft through said moving warp sheds.

43. The method of claim 40 further including the step of synchronizing the longitudinal speed of said weft with the longitudinal speed of said moving warp sheds.

44. The method in accordance with claim 40, wherein the step of inserting weft threads includes the step of inserting one weft thread in one moving warp shed while another weft thread is still traversing another one of said moving warp sheds.

45. In a weaving loom utilizing a plurality of moving warp sheds, wherein the sheds move in the direction of the warp threads, the method of supplying and laying weft threads in each of said moving warp sheds, comprising the steps of:

moving gripper shuttles into a loading area on at least one side of said moving warp sheds for receiving and gripping weft thread, sequentially transferring weft threads to said gripper shuttles, firing a first one of said gripper shuttles with the gripped weft thread through a first moving warp shed firing a second one of said gripper shuttles into a second moving warp shed while said first gripper shuttle is still traversing said first moving warp shed.

46. In a weaving loom utilizing a plurality of moving warp sheads, wherein the sheds move in the direction of the warp threads so that said sheds move in a longitudinal direction, apparatus for supplying and laying weft threads in each of said moving sheds successively and wherein said weft thread is supplied from weft supply means located outside of said sheds, comprising:

weft-insertion means for inserting weft thread from at least one side of said moving warp sheds so that weft thread is inserted in said moving warp sheds during the entire time that said weft-insertion means traverses said moving warp sheds, means for transferring weft thread from said weft supply means to said weft-insertion means, means for sending said weft-insertion means with said weft thread through successive moving warp sheds so that while said weft-insertion means moves through said moving warp shed, it also moves in said longitudinal direction, and means for guiding each of said weft threads to follow the longitudinal movement of its associated weft-insertion means during the traversal of said weft-insertion means through its associated moving warp shed.

47. In the weaving loom of claim 46, wherein said transferring means includes means for transferring said weft thread from stationary weft supply means located outside of said moving warp sheds.

48. In a weaving loom utilizing a plurality of moving warp sheds, wherein the sheds move in a first direction, apparatus for supplying and laying weft threads in each of said moving sheds successively, comprising:

weft-insertion means for inserting weft thread from at least one side of said moving warp sheds, means for sending said weft-insertion means through one of said moving warp sheds in a second direction transverse to said first direction, and means for imparting movement to said weft-insertion means in a direction parallel to said first direction so that while said weft-insertion means moves through said moving warp shed, it also moves in said first direction.

49. The method in accordance with claim 48, further including the step of continuously controlling the position and tension of each of the weft threads from the beginning of weft insertion until the weft thread is beat up into the fell of the woven product.

50. In the weaving loom of claim 48, further including means for supplying said weft thread from stationary weft supply means located outside of said moving warp sheds.

51. A method of weaving utilizing a plurality of warp threads and weft threads, comprising the steps of:

forming sheds by shed-forming means for separating warp threads into different planes, and retaining said sheds by means independent of said shed-forming means, moving said sheds in a direction toward the fell of the woven product, and continuously inserting said weft threads into said moving warp sheds by employing means for drawing said weft thread from stationary weft supply packages located outside of said moving warp sheds.

52. The method in accordance with claim 51 further including the step of guiding each of said weft threads to follow the movement of their associated sheds toward the fell of the woven product.

53. The method in accordance with claim 51, further including the step of continuously controlling the position and tension of each of the weft threads from the beginning of weft insertion until the weft thread is beat up into the fell of the woven product.

54. Apparatus for weaving utilizing a plurality of moving warp sheds, wherein weft threads are inserted into each of said moving sheds by weft-insertion means and beat up into the fell of the woven product, comprising:

means for supplying weft thread to said weft-insertion means from stationary weft supply packages located outside of said moving warp sheds, and means for continuously inserting said weft-insertion means through each one of said moving warp sheds.

55. The apparatus of claim 54, further including means for guiding said weft threads to follow the movement of said moving warp sheds during the traversal of said weft-insertion means through said moving warp sheds.

56. The apparatus in accordance with claim 54, further including means for imparting a direction of movement to said weft-insertion means parallel to said warp threads.

57. A method of weaving utilizing a plurality of moving warp sheds formed by shed-forming means for separating warp threads into different planes, wherein said sheds move in a direction parallel to the warp threads, and wherein weft threads are inserted into each of said moving warp sheds by weft-insertion means and beat up into the fell of the woven product, comprising the steps of:

retaining said moving sheds by means independent of said shed-forming means, supplying weft thread to said weft-insertion means, and sending said weft-insertion means through each one of said moving warp sheds.

58. The method of claim 57, further including the step of guiding said weft threads to follow the movement of said moving warp sheds during the traversal of said weft-insertion means through said moving warp sheds.

59. The method in accordance with claim 57, further including the step of imparting a direction of movement to said weft-insertion means parallel to said warp threads.

60. A method of weaving utilizing a plurality of moving warp sheds, wherein weft threads are inserted into each of said moving sheds by weft-insertion means and beat up into the fell of the woven product, comprising the steps of:

moving said warp sheds along a substantially flat plane toward the fell of the woven product, supplying weft thread to said weft-insertion means from stationary weft supply packages located outside of said moving warp sheds, and continuously inserting said weft-insertion means through each one of said moving warp sheds.

61. The method of claim 60, further including the step of guiding said weft threads to follow the movement of said moving warp sheds during the traversal of said weft-insertion means through said moving warp sheds.

62. The method in accordance with claim 60, further including the step of imparting a direction of movement to said weft-insertion means parallel to said warp threads.

63. A method of weaving utilizing a plurality of moving warp sheds, wherein said sheds move in a direction parallel to the warp threads, and wherein weft threads are inserted into each of said moving sheds by gripper shuttles and beat up into the fell of the woven product, the method of supplying and laying weft threads in each of said moving warp sheds, comprising the steps of:

moving said warp sheds along a substantially flat plane toward the fell of the woven product, transferring a weft thread to said gripper shuttles by employing transferring means to transfer said weft thread, and sending said gripper shuttles through successive ones of said moving warp sheds.

64. The method of claim 63, wherein the step of transferring a weft thread includes the step of supplying weft threads from a plurality of stationary weft supply packages to a plurality of gripper shuttles.

65. The method in accordance with claim 63, further including the step of guiding each of said weft threads to follow the movement of their associated sheds toward the fell of the woven product.

66. The method in accordance with claim 63, further including the step of imparting a direction of movement to said gripper shuttle parallel to said warp threads.

67. The method in accordance with claim 63, further including the step of sending gripper shuttles through said moving warp sheds from each side of said moving warp sheds so that weft thread is inserted into said moving sheds in two directions.

* * * * *

UNITED STATES PATENT AND TRADEMARK OFFICE

CERTIFICATE OF CORRECTION

PATENT NO. : 4,122,872

DATED : October 31, 1978

INVENTOR(S) : Thomas F. McGinley

It is certified that error appears in the above-identified patent and that said Letters Patent are hereby corrected as shown below:

Column 1, line 41, the word "wef-laying" should read -- weft-laying --.

Column 2, line 36, the word "inention" should read -- invention --.

Column 7, line 8, the word "a" should read -- as --.

Column 9, line 64, the number "39," should read -- 36, --.

Column 11, line 62, the number "184" should read -- 184' --.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*